US005642571A

United States Patent [19]

Park

[11] Patent Number: 5,642,571

[45] Date of Patent: Jul. 1, 1997

[54] COATING LAYER DRYING SYSTEM FOR A CATHODE RAY TUBE

[75] Inventor: Dae-in Park, Kyungsangnam-do, Rep. of Korea

[73] Assignee: Samsung Display Devices Co., Ltd., Kyungki-do, Rep. of Korea

[21] Appl. No.: 631,027

[22] Filed: Apr. 12, 1996

[30] Foreign Application Priority Data

Apr. 18, 1995 [KR] Rep. of Korea ..... 95-7891

[51] Int. Cl.[6] ..... F26B 19/00

[52] U.S. Cl. ..... 34/202; 34/219

[58] Field of Search ..... 34/202, 219, 221; 454/238; 236/15 C

[56] References Cited

U.S. PATENT DOCUMENTS

| | | | |
|---|---|---|---|
| 179,414 | 7/1876 | Kelly | 454/238 |
| 1,296,968 | 3/1919 | Klein | 34/221 X |
| 2,390,902 | 12/1945 | Vollrath | 236/15 C |
| 2,505,973 | 5/1950 | Julian | 34/221 |
| 3,314,159 | 4/1967 | Betz | 34/219 |
| 4,771,728 | 9/1988 | Bergman, Jr. | 34/221 |
| 5,271,161 | 12/1993 | Brinck, II | 34/219 |

*Primary Examiner*—John M. Sollecito
*Assistant Examiner*—Steve Gravini
*Attorney, Agent, or Firm*—Christie, Parker & Hale, LLP

[57] ABSTRACT

A coating layer drying system for a cathode ray tube (CRT) includes a furnace. A pedestal for placing a CRT bulb on is installed in the inside of the furnace. Both ends of a hose are fixed on the side walls of the furnace. A heater for heating low temperature air is connected to the hose. A pump for ventilating high pressure air is also connected to the hose. A pressure gauge for checking the inner pressure of the furnace is fixed on the upper part of the furnace. A temperature gauge for sensing the inner temperature of the furnace is also fixed on the upper part of the furnace. And, in addition, a controlling element for controlling the operation of the pump and the heater is installed next to the furnace.

11 Claims, 1 Drawing Sheet

COATING LAYER DRYING SYSTEM FOR A CATHODE RAY TUBE

BACKGROUND OF THE INVENTION

This invention relates to a coating layer drying system for a cathode ray tube (CRT), and more particularly to the drying system in which it is possible to dry a coating layer at a low temperature using a super critical drying method.

In general, a CRT includes a panel inside of which a black matrix layer and a fluorescent layer are formed, a funnel which is internally attached to the panel and on the circumference of which a deflection yoke is installed, and a bulb which is formed with a neck equipped with an electron gun, the neck being connected to the rear of the funnel.

When manufacturing the CRT like the above, a coating layer is formed on the outer surface of the panel, The coating layer prevents static electricity generated by an electrostatic charge and increases the contrast of the pictures realized in the CRT.

The usual method used in forming the coating layer involves the following processes: a process for injecting a little coating fluid into the center of the outer surface of the panel placed in the bulb; a process for turning the bulb around in order that the coating fluid may be applied over the complete surface of the panel; a process for moving the bulb retaining the coating layer into a drying system; and a process for drying the coating layer.

In general, the drying system is furnished with a furnace which keeps its inner temperature at a stable and constant level using an electric heater or hot wind. In order to dry the coating layer using the furnace, the following steps are needed: a step for elevating the inner temperature of the furnace to a certain degree; a step for moving the bulb retaining the coating layer inside the furnace; and a step for drying the coating layer by the heat in the inner part of the furnace.

However, the conventional drying system for the CRT has some problems. For example, the furnace used in the drying system is very large. Also, the drying system needs a complicated electric heater or a complicated device ventilating hot wind. As a result, the drying system bears a high installation fee and exorbitant maintenance costs.

Furthermore, there is another problem in the drying system. That is, when the coating layer is dried in the inside of the furnace, since the length of the furnace is substantial, total drying time becomes increased as the time required for the bulb to pass through the entire length of the furnace is great, and thus the drying system results in a drop in operation efficiency.

SUMMARY OF THE INVENTION

Accordingly, the present invention has been made in an effort to solve the above-described problems.

It is an object of the present invention to provide a drying system which can be easily controlled and in which a short drying time can be obtained, and all this while using a small space.

To achieve the above objective, the present invention provides a coating layer drying system for a CRT including a furnace. A pedestal on which a CRT bulb is supportedly placed is installed inside the furnace. Both ends of a hose are repectively fixed on the side walls of the furnace. A heater for heating low temperature air is connected to the hose. Also, a pump for forcibly ventilating air is connected to the hose.

The drying system further includes a pressure gauge for checking the inner pressure of the furnace. The pressure gauge is fixed on the upper part of the furnace.

The drying system also includes a temperature gauge for sensing the inner temperature of the furnace. The temperature gauge is fixed on the upper part of the furnace.

And, in addition, the drying system includes a controlling element. The controlling element controls the operation of the heater and the pump by getting information of the inner state of the furnace from the pressure gauge and the temperature gauge.

BRIEF DESCRIPTION OF THE DRAWING

The accompanying drawing, which is incorporated in and constitutes a part of the specification, illustrates an embodiment of the invention, and, together with the description, serves to explain the principles of the invention.

DETAILED DESCRIPTION

Figure 1:
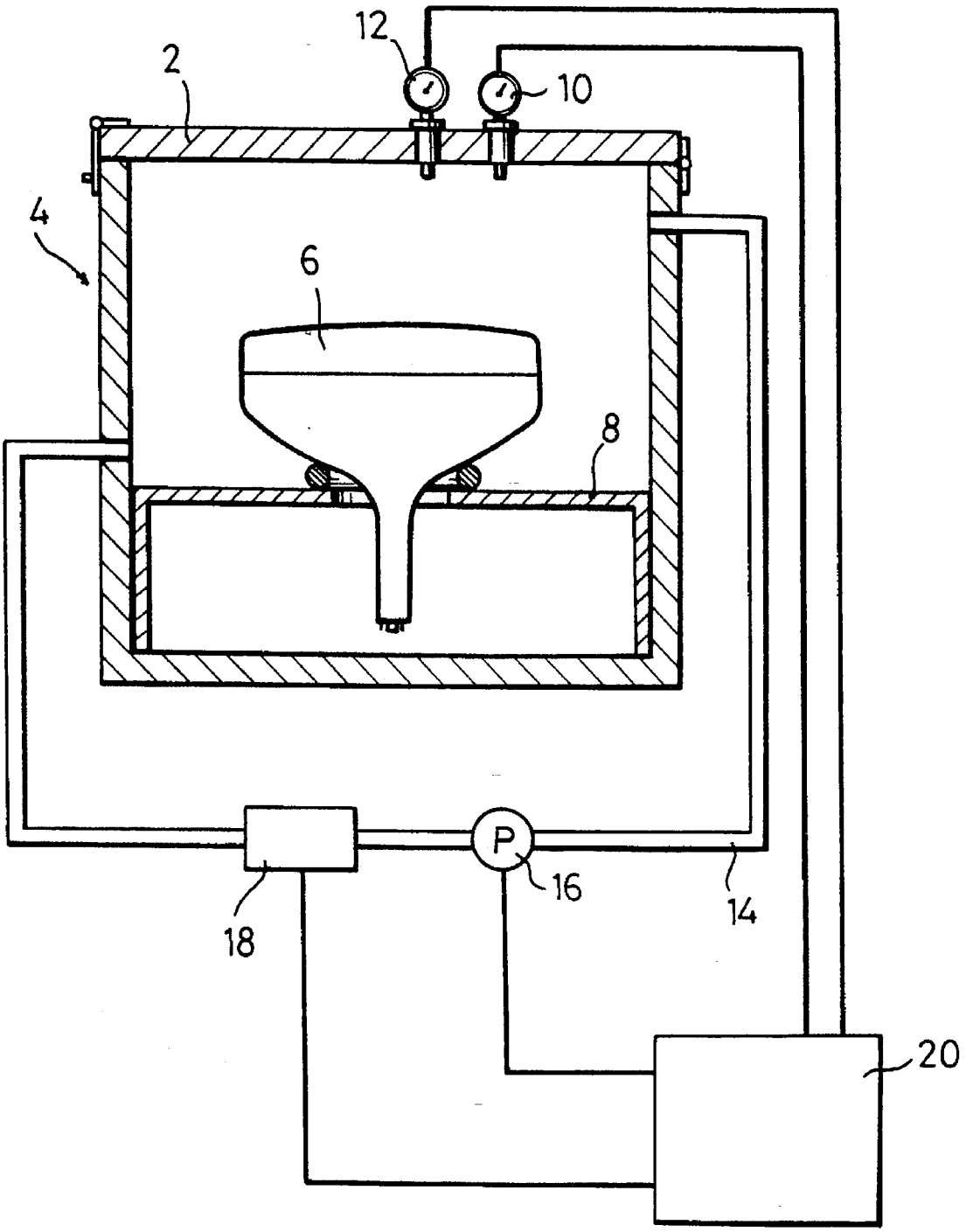
FIG. 1 is a cross-sectional view illustrating a coating layer drying system according to a preferred embodiment of the present invention.

A preferred embodiment of the present invention will now be described in detail with reference to the accompanying drawing.

FIG. 1 roughly shows a structure of the coating layer drying system according to a preferred embodiment of the present invention.

As shown in the drawing, the inventive drying system includes a furnace 4. A door 2 is positioned on the upper part of the furnace 4. And, a pedestal 8 on which a CRT bulb 6 is supportedly placed is installed in the inside of the furnace 4.

The drying system further includes a temperature gauge 10 for checking the inner temperature of the furnace 4 and a pressure gauge 12 for checking the inner pressure of the furnace 4. The temperature gauge and the pressure gauge are respectively fixed on the door 2.

The drying system also includes a hose 14 having a predetermined length. The hose is connected to the side walls of the furnace 4. And, a pump 16 for ventilating high tension air and a heater 18 for converting low temperature air emitted from the inner part of the furnace to high temperature air are respectively connected to the hose.

And further, the drying system includes a controlling element 20 which is installed next to the furnace 4 and electrically connected with the pump 16 and the heater 18 as well as the temperature gauge 10 and the pressure gauge 12. The controlling element 20 controls the operation of the pump 16 and the heater 18.

As structurally characterized above, the operation of the present invention can be described as shown below.

First, when opening the door 2 positioned on the upper part of the furnace 4 and then placing the CRT bulb 6 on the pedestal 8, the door 2 is closed.

As described above, when placing the CRT bulb 6 inside the furnace 4, the pump 16 begins working and simultaneously the heater 18 becomes heated, and thus the heater converts low temperature air to high temperature air and the pump ventilates high temperature air inside the furnace.

As described above, when ventilating high temperature and pressure air inside the furnace 4, the air begins rotating in the furnace 4 and drying the coated part of the CRT bulb 6, and then the pump emits the inside air of the furnace 4 through the hose 14. But, the emitted air has been re-heated by the heater 18 and becomes again ventilated inside the furnace 4 through the hose 14.

As described above, during the process of rotating high temperature and pressure air ventilated inside the furnace 4, the temperature gauge 12 senses the temperature of air and transmits it to the controlling element 20, and then the controlling element 20 controls the temperature of the rotating air by turning the heater 18 on or off depending on the predetermined high degree of temperature.

Likewise, when the pressure gauge 12 has checked the inner pressure of the furnace 4 and transmitted it to the controlling element 20, the controlling element 20 controls the speed of revolution of the pump 16 depending on the predetermined inner pressure of the furnace, so that constant and regular pressure can be kept.

While this invention has been described in connection with what is presently considered to be the most practical and preferred embodiment, it is to be understood that the invention is not limited to the disclosed embodiment, but, on the contrary, it is intended to cover various modifications and equivalent arrangements included within the spirit and scope of the appended claims.

What is claimed is:

1. A coating layer drying system for a cathode ray tube (CRT) comprising:

a furnace;

a pedestal for receiving a CRT bulb, the pedestal being installed inside the furnace;

a hose having both ends connected to the furnace;

a heater connected to the hose for maintaining a predetermined temperature inside the furnace; and a pump connected to the hose for maintaining a predetermined pressure inside the furnace.

2. The drying system of claim 1 further comprising a pressure gauge connected to the furnace for sensing the pressure inside the furnace.

3. The drying system of claim 1 further comprising a temperature gauge connected to the furnace for sensing the temperature inside the furnace.

4. The drying system of claim 2 further comprising a controlling element for controlling the operation of the pump responsive to the pressure gauge.

5. The drying system of claim 3 further comprising a controlling element for controlling the operation of the heater responsive to the temperature gauge.

6. The drying system of claim 1 further comprising a pressure gauge connected to the furnace for sensing the pressure inside the furnace, and a temperature gauge connected to the furnace for sensing the temperature inside the furnace.

7. The drying system of claim 6 further comprising a controlling element for controlling the operation of the heater responsive to the temperature gauge and the pump responsive to the pressure gauge.

8. A coating layer drying system for a cathode ray tube (CRT) comprising:

a furnace;

means for supporting a CRT bulb inside the furnace;

a heater coupled to the furnace for maintaining a predetermined temperature inside the furnace; and a pump coupled to the furnace for maintaining a predetermined pressure inside the furnace.

9. The drying system of claim 8 wherein said supporting means comprises a pedestal.

10. The drying system of claim 8 further comprising means for connecting the pump and heater to the furnace such that the pump causes air to be passed from the heater to the furnace.

11. The drying system of claim 10 wherein said connecting means comprises a hose.

* * * * *